US007625213B1

(12) United States Patent
Tse

(10) Patent No.: US 7,625,213 B1
(45) Date of Patent: Dec. 1, 2009

(54) MAGNETIC MEANS FOR DETACHABLY AND ROTATABLY CONNECTING COMPONENTS IN AN AUDIO SPEAKER SYSTEM

(75) Inventor: Kin Man Michael Tse, New Territories (HK)

(73) Assignee: Plastoform Industries Ltd., N.T. (HK)

( * ) Notice: Subject to any disclaimer, the term of this patent is extended or adjusted under 35 U.S.C. 154(b) by 0 days.

(21) Appl. No.: 12/343,472

(22) Filed: Dec. 23, 2008

(51) Int. Cl.
*H01R 11/30* (2006.01)

(52) U.S. Cl. ..... 439/39; 439/22

(58) Field of Classification Search ..... 439/39, 439/38, 22, 27, 13, 700
See application file for complete search history.

(56) References Cited

U.S. PATENT DOCUMENTS 5,401,175 A * 3/1995 Guimond et al. ..... 439/38
6,030,229 A * 2/2000 Tsutsui ..... 439/39

* cited by examiner

*Primary Examiner*—Phuong K Dinh

(57) ABSTRACT

Magnetic means for detachably and rotatably connecting components in an audio speaker system which comprises a transmitter module securely disposed in a power and/or signal source of the audio system and a corresponding receiver module securely disposed in a power and/or signal receiving means of the audio system, each of the transmitter module and the receiver module comprises a ring-shaped magnetic body, a first electrically insulated layer, a conductive pin, a conductive plate, a second magnetically insulated layer and a bracket, wherein the transmitter module has a first polarity at the front wall of the magnetic body thereof and a second polarity opposite to the first polarity at a front end of the bracket thereof, and the receiver module has the second polarity at the front wall of the magnetic body thereof and the first polarity at a front end of the bracket thereof, and the magnetic body and the bracket of the transmitter module have the same diameter as those of the receiver module, so that when the power and/or signal source is activated and the receiver module is connected to the transmitter module, the magnetic bodies and the brackets of transmitter module and the receiver module are rotatably attracted and connected to each other and power and/or signal is transmitted from the transmitter module to the receiver module via the conductive plates and the brackets thereof, and the conductive pins of the transmitter module and the receiver module connect with each other so that power and/or signal is transmitted from the transmitter module to the receiver module.

10 Claims, 7 Drawing Sheets

MAGNETIC MEANS FOR DETACHABLY AND ROTATABLY CONNECTING COMPONENTS IN AN AUDIO SPEAKER SYSTEM

BACKGROUND OF THE INVENTION

Conventional audio speaker system generally comprises an amplifier, a left speaker and a right speaker. In some systems, the amplifier serves as the source of signal and power, and the left and the right speakers are connected to the amplifier by means of wires. In some systems, the left and the right speakers are each installed with an amplifier; in other systems, either the left or the right speaker is installed with an amplifier. In either case, the left and the right speakers are connected by means of wires. The wires not only create a messy environment for the users, but also pose restrictions for designers in product design for speaker systems.

BRIEF SUMMARY OF THE INVENTION

In view of the aforesaid disadvantages now present in the prior art, the object of the present invention is to provide a magnetic means for detachably and rotatably connecting components in an audio speaker system which replaces conventional wiring connections and thus overcoming shortcomings of the prior art.

To attain this, the present invention generally comprises a transmitter module securely disposed in a power and/or signal source of the audio system and a corresponding receiver module securely disposed in a power and/or signal receiving means of the audio system. Each of the transmitter module and the receiver module comprises a ring-shaped magnetic body, a first electrically insulated layer, a conductive pin, a conductive plate, a second magnetically insulated layer and a bracket. The magnetic body has a front wall, a rear wall, an outer wall and an inner wall. The first electrically insulated layer surrounds the inner wall of the magnetic body. The conductive pin passes through the first electrically insulated layer, and a rear end thereof is electrically connected to a power and/or signal circuit. The conductive plate connects to the rear wall of the magnetic body and is disposed in an electrically insulated manner from the conductive pin, and the conductive plate is electrically connected to a power and/or signal circuit. The second magnetically insulated layer has an insulated outer wall and an insulated inner wall, and the insulated inner wall surrounds the outer wall of the magnetic body. The bracket is electrically and magnetically conductive, and it surrounds the insulated outer wall of the second magnetically insulated layer and connects to the conductive plate, and the bracket is magnetically insulated from the front wall and the outer wall of the magnetic body. As a result, from a cross-sectional point of view, the magnetic body and the bracket are each divided into an upper part and a lower part by the conductive pin, and the conductive plates serve to connect the magnetic bodies and the brackets in each of the upper part and the lower part and the three form a substantially U-shaped magnet with the magnetic poles lie at the front ends of the bracket and the magnetic body respectively. The second magnetically insulated layer insulates the front wall and the outer wall of the magnetic body from the bracket and thus separating the two magnetic poles. The total magnetic force is thereby increased and more secure connection between the transmitter module and the receiver module can be achieved. The transmitter module has a first polarity at the front wall of the magnetic body thereof and a second polarity opposite to the first polarity at a front end of the bracket thereof, and the receiver module has the second polarity at the front wall of the magnetic body thereof and the first polarity at a front end of the bracket thereof, and the magnetic body and the bracket of the transmitter module have the same diameter as those of the receiver module, so that when the power and/or signal source is activated and the receiver module is connected to the transmitter module, the magnetic bodies and the brackets of transmitter module and the receiver module are rotatably attracted and connected to each other and power and/or signal is transmitted from the transmitter module to the receiver module via the conductive plates and the brackets thereof, and the conductive pins of the transmitter module and the receiver module connect with each other so that power and/or signal is transmitted from the transmitter module to the receiver module.

A front end of the conductive pin of the receiver module is spring-loaded to movably protrude outward from the front wall of the magnetic body of the receiver module, and a front end of the conductive pin of the transmitter module is securely disposed within the first electrically insulated layer of the transmitter module, thereby resulting in secure connection of the conductive pins when the transmitter module and the receiver module are connected with each other. Since the transmitter module is an active signal and/or power transmitter, the conductive pin of the transmitter module is completely enclosed within the first electrically insulated layer so as to prevent user or any external substance from coming into contact with the conductive pin and thus prevent the occurrence of short circuit.

An electrically insulated casing is provided at a rear side of the conductive plate for encasing the conductive pin.

The front end of the bracket extends inward towards the magnetic body so as to provide more surface area for magnetically connecting the transmitter module and the receiver module and concentrate the magnetic force at the front end of the bracket.

Accordingly, the second magnetically insulated layers each has a front wall which extends inward towards the magnetic bodies to insulate inner surface of the front end of the bracket from the front wall of the magnetic body and hold the magnetic bodies in place and thereby preventing the magnetic bodies from colliding with each other when the transmitter module and the receiver module connect with each other. Since the magnetic bodies are made of relatively brittle material, this could lower the risks of damaging the magnetic bodies when the transmitter module and the receiver module connect with each other.

In a preferred embodiment, one or more soldering tag is extended from each conductive plate through the bracket and the soldering tag is electrically connected to a power and/or signal circuit.

The magnetic body of a most preferred embodiment takes the form of a neodymium-ferrite-boron magnet as neodymium-ferrite-boron can provide better magnetic strength. In other embodiments, it is also possible to use other magnetic materials such as ferrite.

The bracket of a most preferred embodiment is made of a ferrous material, and more preferably iron.

The operation of the present invention is explained in detail as follows:

In an audio system which comprises an amplifier, a left speaker and a right speaker, the amplifier is securely installed with one or more transmitter modules and the left speaker and the right speaker are each securely installed with one or more receiver modules. The conductive pins are each electrically connected to a first terminal of the power and/or signal circuit and the conductive plates are each electrically connected to a second terminal of the power and/or signal circuit.

When the user wishes to connect the left speaker to the amplifier, the user aligns one of the receiver modules of the left speaker to one of the transmitter modules of the amplifier according to the desired orientation and position of the speaker in relation to the amplifier. When the receiver module is close to the transmitter module, the magnetic force of the magnetic body draws the receiver module and the transmitter module towards each other. The receiver module is therefore connected to the transmitter module. Since the magnetic body and the bracket of the receiver module and the transmitter module are both in shape of a ring and of the same diameter, the user may rotate the speaker in relation to the amplifier or vice versa to a preferred orientation without disrupting the connection between the receiver module and the transmitter module. The user may then connect the right speaker to the amplifier in the same way as mentioned.

When the power and signal source is activated and the receiver module is connected to the transmitter module, power and/or signal is transmitted from the transmitter module to the receiver module via the conductive plates and the brackets thereof, and the conductive pins of the transmitter module and the receiver module connect with each other so that power/signal is transmitted from the transmitter module to the receiver module.

When the receiver module and the transmitter module are connected to each other, the magnetic field of the magnetic bodies is conducted via the conductive plates to the brackets, thus the magnetic bodies, the conductive plates and the brackets in each of the upper part and the lower part form a substantially U-shaped magnet with the poles both lie at the front ends of the bracket and the magnetic body, thereby increasing the total magnetic force and achieving more secure connection between the transmitter module and the receiver module. Even when the power and signal source is activated, the user may still rotate the speaker in relation to the amplifier or vice versa to a preferred orientation without disrupting the connection between the receiver module and the transmitter module since the magnetic force keeps the receiver module and the transmitter module in contact with each other.

To disengage the speaker from the amplifier, the user simply pulls the speaker away from the amplifier. When such external force exceeds the magnetic force, the speaker automatically disengages from the amplifier, and the power and/or signal connection is automatically terminated.

Further objects, features, and advantages of the invention will become more apparent from the following description and the appended claims with reference to the accompanying drawings, all of which form a part of this specification. It should be understood, however, that the description and the specific example(s) while representing the preferred embodiment(s) are/is given by way of illustration only.

DETAILED DESCRIPTION OF THE INVENTION

The present invention is further described in detail with the following embodiment and the accompanying drawings.

Figure 1:
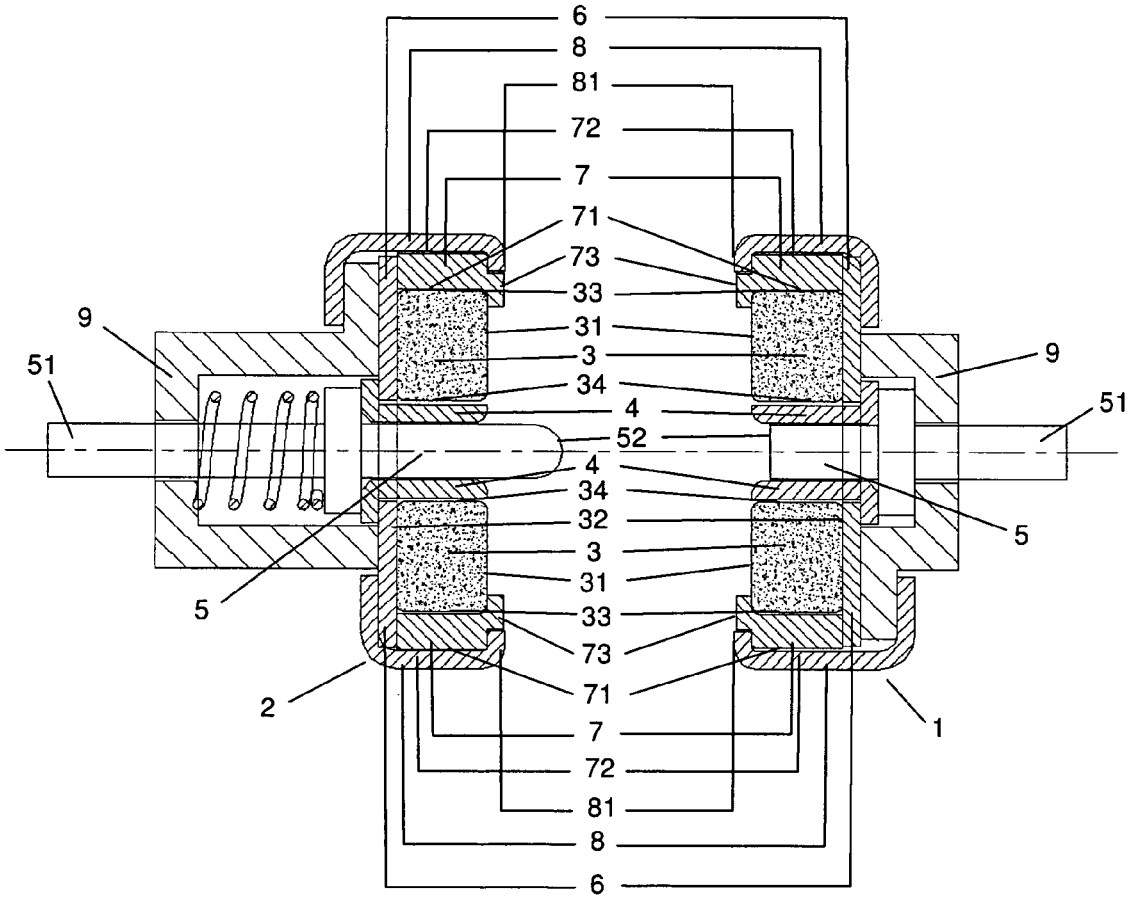
FIG. 1 is a cross-sectional view of the transmitter module and the receiver module of the first embodiment of the present invention.
Figure 2:
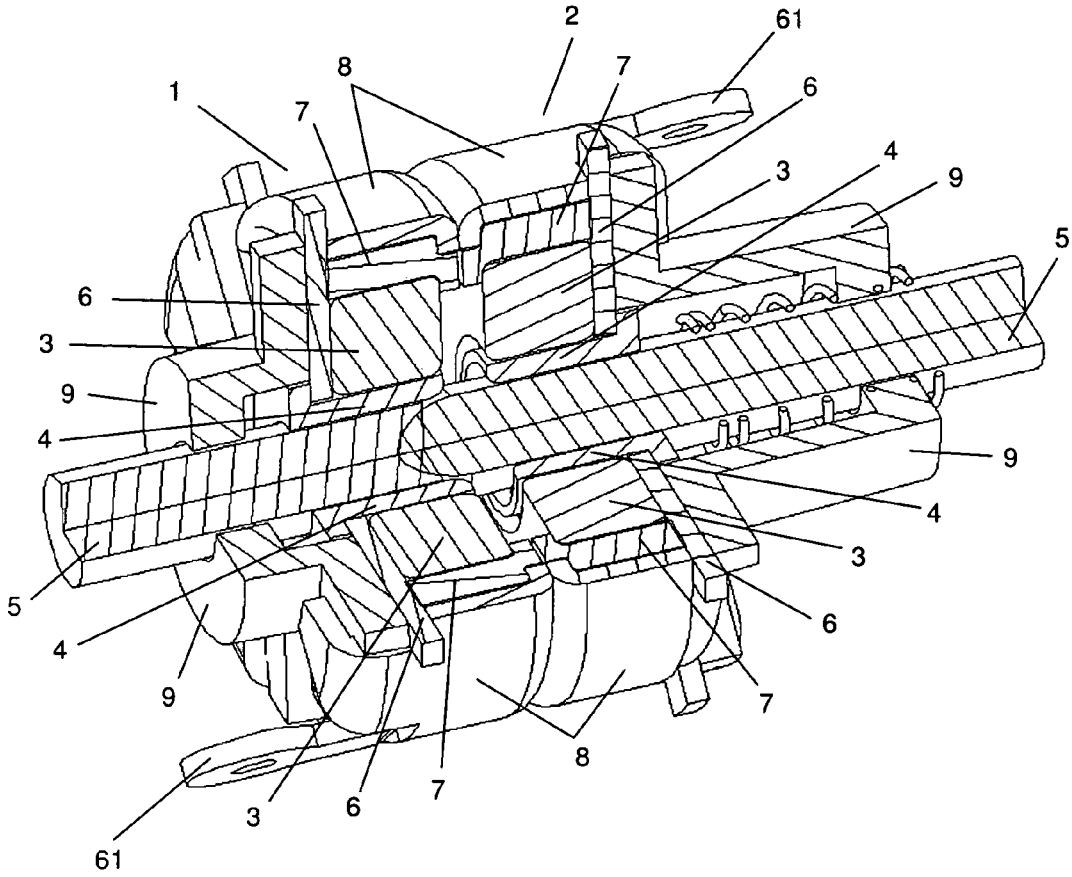
FIG. 2 is a partial perspective view of the transmitter module and the receiver module of the first embodiment of the present invention.
Figure 3:
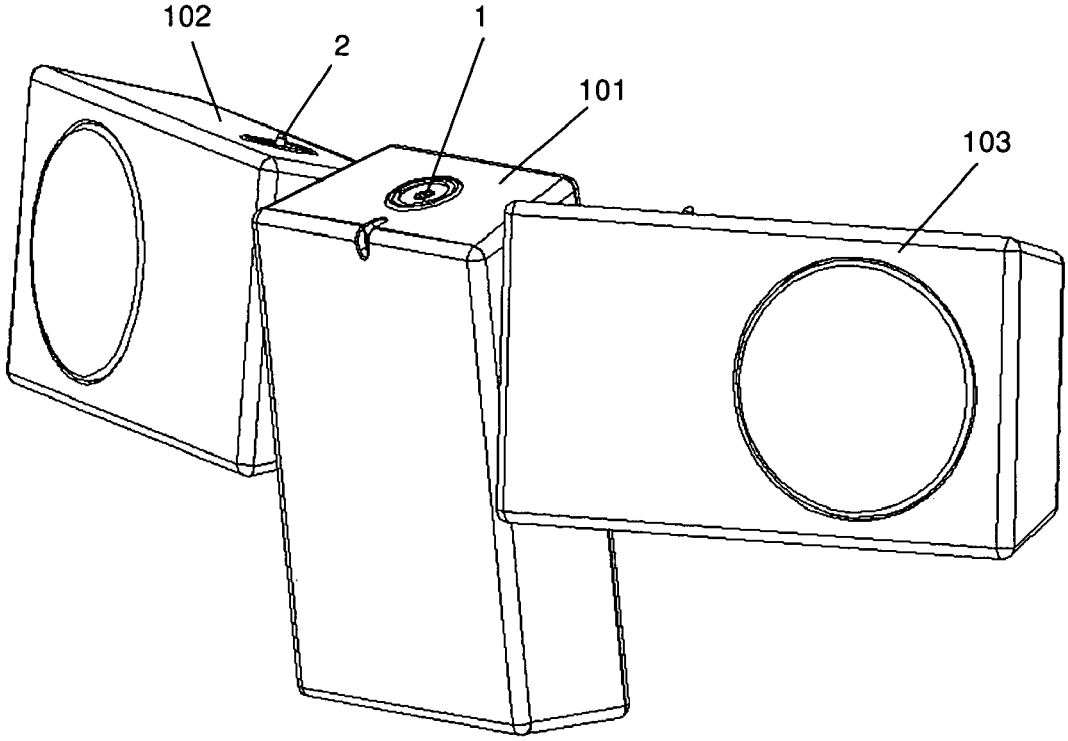
FIG. 3 is a perspective view illustrating the left and right speakers as connected to the amplifier.
Figure 4:
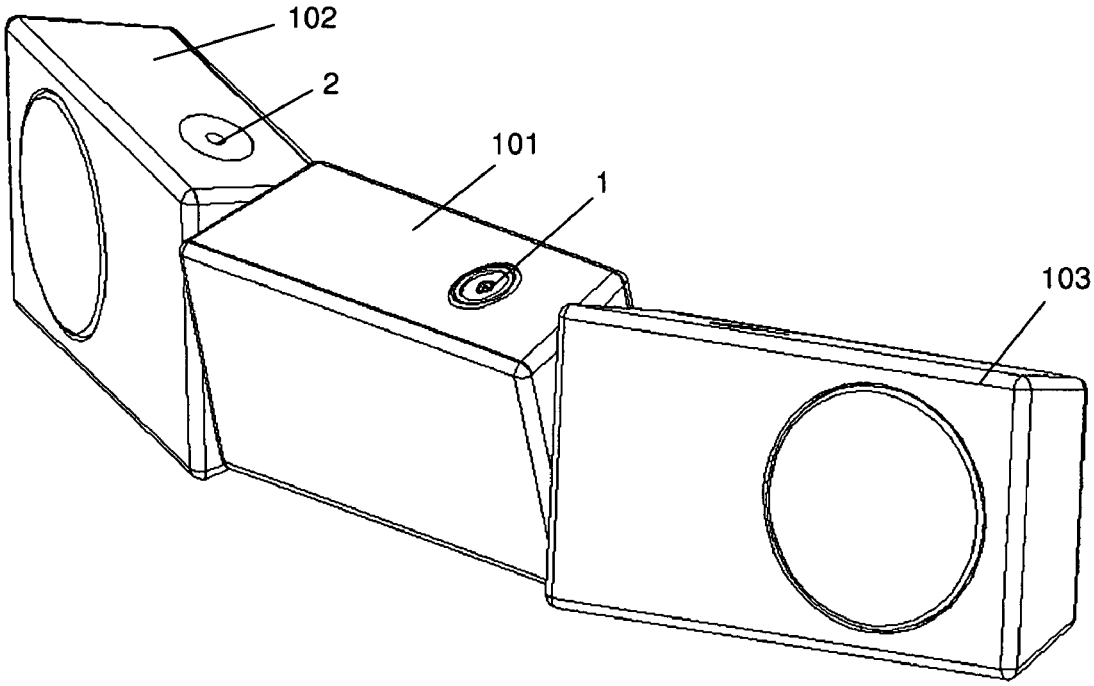
FIG. 4 is a perspective view illustrating the left and right speakers as connected to the amplifier in another combination.
Figure 5:
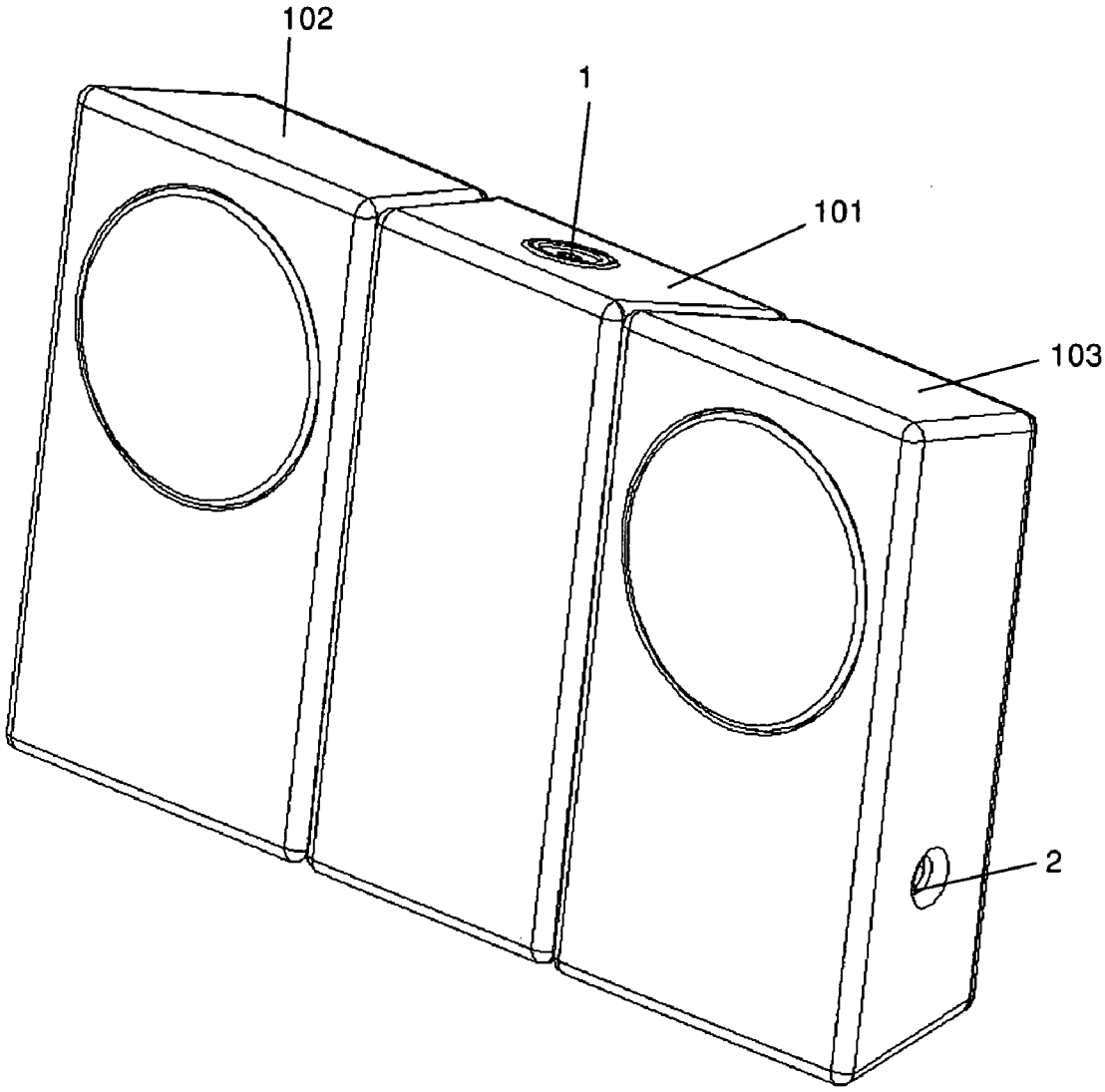
FIG. 5 is a perspective view illustrating the left and right speakers as connected to the amplifier in yet another combination.
Figure 6:
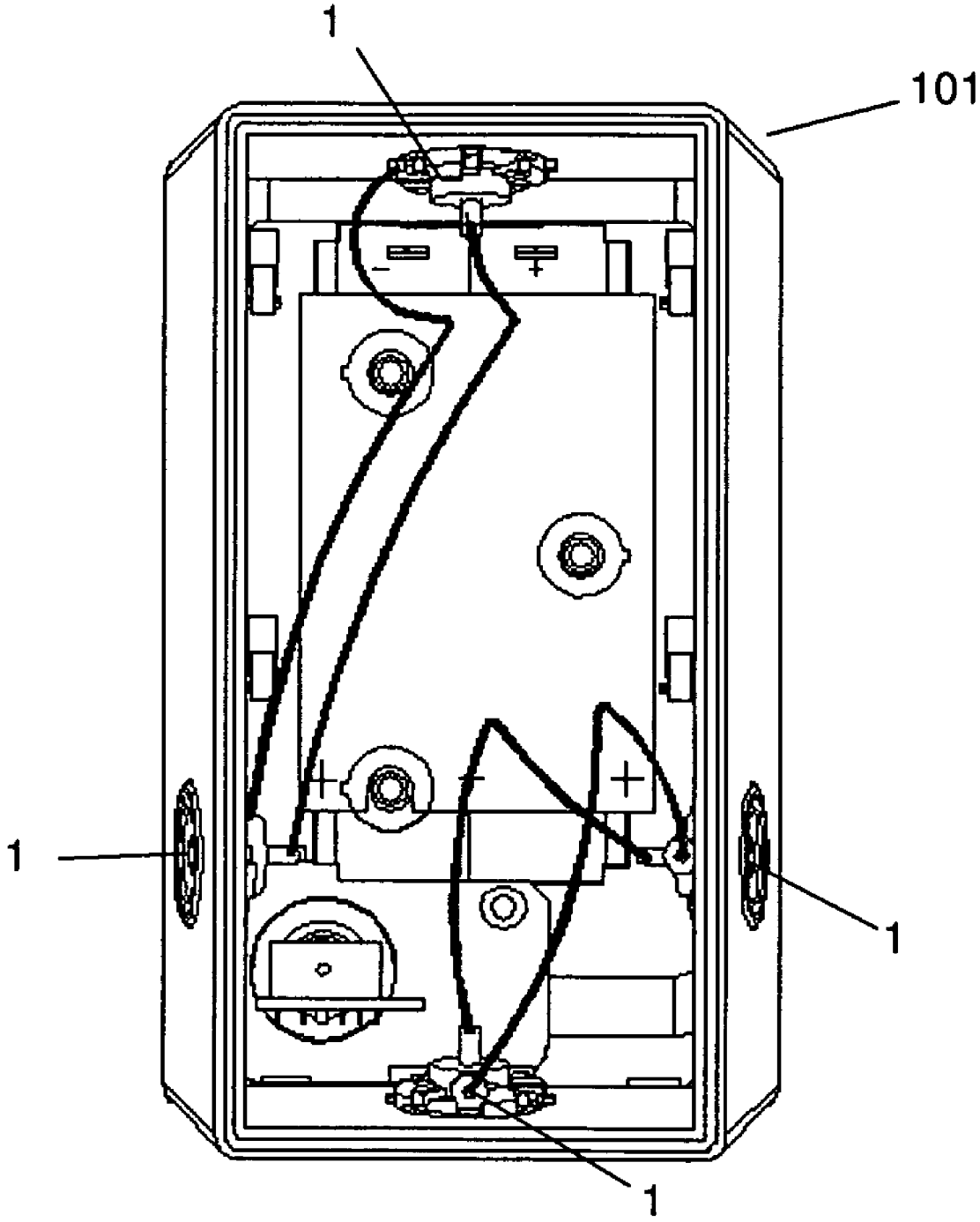
FIG. 6 is a view illustrating the amplifier and the transmitter modules installed therein.
Figure 7:
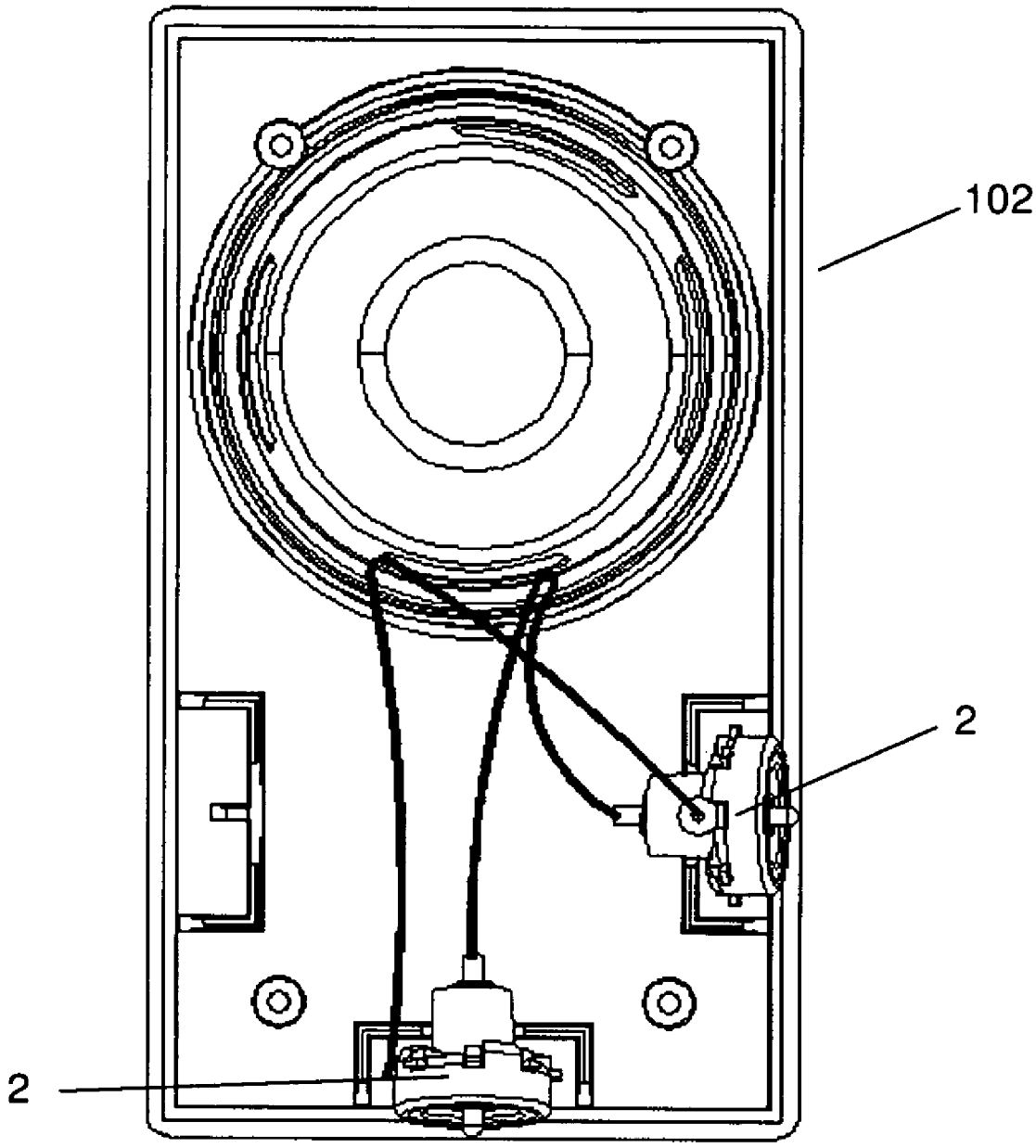
FIG. 7 is a view illustrating the left speaker and the receiver modules installed therein.

As illustrated in FIGS. 1 to 7, the present invention generally comprises a transmitter module 1 securely disposed in a power and/or signal source of the audio system and a corresponding receiver module 2 securely disposed in a power and/or signal receiving means of the audio system. Each of the transmitter module 1 and the receiver module 2 comprises a ring-shaped magnetic body 3, a first electrically insulated layer 4, a conductive pin 5, a conductive plate 6, a second magnetically insulated layer 7 and a bracket 8. The magnetic body 3 has a front wall 31, a rear wall 32, an outer wall 33 and an inner wall 34. The first electrically insulated layer 4 surrounds the inner wall 34 of the magnetic body 3. The conductive pin 5 passes through the first electrically insulated layer 4, and a rear end 51 thereof is electrically connected to a power and/or signal circuit. The conductive plate 6 connects to the rear wall 32 of the magnetic body 3 and is disposed in an electrically insulated manner from the conductive pin 5, and a soldering tag 61 is extended from the conductive plate 6 through the bracket 8 to electrically connect the conductive plate 6 to a power and/or signal circuit. The second magnetically insulated layer 7 has an insulated outer wall 71 and an insulated inner wall 72, and the insulated inner wall 72 surrounds the outer wall 33 of the magnetic body 3. The bracket 8 which is electrically and magnetically conductive surrounds the insulated outer wall 71 of the second magnetically insulated layer 7 and connects to the conductive plate 6, and the bracket 8 is magnetically insulated from the front wall 31 and the outer wall 33 of the magnetic body 3. As a result, from a cross-sectional point of view, the magnetic body 3 and the bracket 8 are each divided into an upper part and a lower part by the conductive pin 5, and the conductive plates 6 serve to connect the magnetic bodies 3 and the brackets 8 in each of the upper part and the lower part and the three form a substantially U-shaped magnet with magnetic poles lie at the front ends of the bracket and the magnetic body respectively. The second magnetically insulated layer 7 insulates the front wall 31 and the outer wall 33 of the magnetic body 3 from the bracket 8 and thus separating the two magnetic poles. The total magnetic force is thereby increased and more secure connection between the transmitter module 1 and the receiver module 2 can be achieved. The transmitter module 1 has a first polarity at the front wall 31 of the magnetic body 3 thereof and a second polarity opposite to the first polarity at a front end 81 of the bracket 8 thereof, and the receiver module 2 has the second polarity at the front wall 31 of the magnetic body 3 thereof and the first polarity at a front end 81 of the bracket 8 thereof, and the magnetic body 3 and bracket 8 of the transmitter module 1 have the same diameter as those of the receiver module 2, so that when the power and/or signal source is activated and the receiver module 2 is connected to the transmitter module 1, the magnetic bodies 3 and the brackets 8 of transmitter module 1 and the receiver module 2 are rotatably attracted and connected to each other and power and/or signal is transmitted from the transmitter module 1 to the receiver module 2 via the conductive plates 6 and the brackets 8 thereof, and the conductive pins 5 of the transmitter module 1 and the receiver module 2 connect with each other so that power and/or signal is transmitted from the transmitter module 1 to the receiver module 2.

A front end 52 of the conductive pin 5 of the receiver module 2 is spring-loaded to movably protrude outward from the front wall 31 of the magnetic body 3 of the receiver module 2, and a front end 52 of the conductive pin 5 of the transmitter module 1 is securely disposed within the first electrically insulated layer 4 of the transmitter module 1, thereby resulting in secure connection of the conductive pins 5 when the transmitter module 1 and the receiver module 2 are connected with each other. Since the transmitter module 1 is an active signal and/or power transmitter, the conductive pin 5 of the transmitter module 1 is completely enclosed within the first electrically insulated layer 4 so as to prevent user or any external substance from coming into contact with the conductive pin 5 and thus prevent the occurrence of short circuit.

An electrically insulated casing 9 is provided at a rear side of the conductive plate 6 for encasing the conductive pin 5.

The front end 81 of the bracket 8 extends inward towards the magnetic body 3 so as to provide more surface area for magnetically connecting the transmitter module 1 and the receiver module 2 and concentrate the magnetic force at the front end 81 of the bracket 8.

Accordingly, the second magnetically insulated layers 7 each has a front wall 73 which extends inward towards the magnetic bodies 3 to insulate inner surface of the front end 81 of the bracket 8 from the front wall 31 of the magnetic body 3 and hold the magnetic bodies 3 in place and thereby preventing the magnetic bodies 3 from colliding with each other when the transmitter module 1 and the receiver module 2 connect with each other. Since the magnetic bodies 3 are made of relatively brittle material, this could lower the risks of damaging the magnetic bodies 3 when the transmitter module 1 and the receiver module 2 connect with each other.

The magnetic body 3 of a most preferred embodiment takes the form of a neodymium-ferrite-boron magnet as neodymium-ferrite-boron can provide better magnetic strength. In other embodiments, it is also possible to use other magnetic materials such as ferrite. The bracket 8 of a most preferred embodiment is made of a ferrous material, and more preferably iron.

The operation of the present invention is explained in detail as follows:

In an audio system which comprises an amplifier 101, a left speaker 102 and a right speaker 103, the amplifier 101 is securely installed with one or more transmitter modules 1 and the left speaker 102 and the right speaker 103 are each securely installed with one or more receiver modules 2. The conductive pins 5 are each electrically connected to a first terminal of the power and/or signal circuit and the conductive plates 6 are each electrically connected to a second terminal of the power and/or signal circuit via the soldering tag 61.

When the user wishes to connect the left speaker 102 to the amplifier 101, the user aligns one of the receiver modules 2 of the left speaker 102 to one of the transmitter modules 1 of the amplifier 101 according to the desired orientation and position of the speaker 102 in relation to the amplifier 101. When the receiver module 2 is close to the transmitter module 1, the magnetic force of the magnetic body 3 draws the receiver module 2 and the transmitter module 1 towards each other. The receiver module 2 is therefore connected to the transmitter module 1. Since the magnetic body 3 and the bracket 8 of the receiver module 2 and the transmitter module 1 are both in shape of a ring and of the same diameter, the user may rotate the speaker 102 in relation to the amplifier 101 or vice versa to a preferred orientation without disrupting the connection between the receiver module 2 and the transmitter module 1. The user may then connect the right speaker 103 to the amplifier 101 in the same way as mentioned.

When the power and signal source is activated and the receiver module 2 is connected to the transmitter module 1, power and/or signal is transmitted from the transmitter module 1 to the receiver module 2 via the conductive plates 6 and the brackets 8 thereof, and the conductive pins 5 of the transmitter module 1 and the receiver module 2 connect with each other so that power/signal is transmitted from the transmitter module 1 to the receiver module 2.

When the receiver module 2 and the transmitter module 1 are connected to each other, the magnetic field of the magnetic bodies 3 is conducted via the conductive plates 6 to the brackets 8, thus the magnetic bodies 3, the conductive plates 6 and the brackets 8 in each of the upper part and the lower part form a substantially U-shaped magnet with the poles both lie at the front ends of the bracket 8 and the magnetic body 3, thereby increasing the total magnetic force and achieving more secure connection between the transmitter module 1 and the receiver module 2. Even when the power and signal source is activated, the user may still rotate the speaker 102,103 in relation to the amplifier 101 or vice versa to a preferred orientation without disrupting the connection between the receiver module 2 and the transmitter module 1 since the magnetic force keeps the receiver module 2 and the transmitter module 1 in contact with each other.

To disengage the speaker 102,103 from the amplifier 101, the user simply pulls the speaker 102,103 away from the amplifier 101. When such external force exceeds the magnetic force, the speaker 102,103 automatically disengages from the amplifier 101, and the power and/or signal connection is automatically terminated.

The above embodiment is a preferred embodiment of the present invention. The present invention is capable of other embodiments and is not limited by the above embodiment. Any other variation, decoration, substitution, combination or simplification, whether in substance or in principle, not deviated from the spirit of the present invention, is replacement or substitution of equivalent effect and falls within the scope of protection of the present invention.

What is claimed is:

1. Magnetic means for detachably and rotatably connecting components in an audio speaker system which comprises a transmitter module securely disposed in a power and/or signal source of the audio system and a corresponding receiver module securely disposed in a power and/or signal receiving means of the audio system, each of the transmitter module and the receiver module comprises a ring-shaped magnetic body with a front wall, a rear wall, an outer wall and an inner wall;

a first electrically insulated layer surrounding the inner wall of the magnetic body;

a conductive pin passing through the first electrically insulated layer with a rear end electrically connected to a power and/or signal circuit;

a conductive plate which connects to the rear wall of the magnetic body and is disposed in an electrically insulated manner from the conductive pin, and a rear end of the conductive plate is electrically connected to a power and/or signal circuit;

a second magnetically insulated layer having an insulated outer wall and an insulated inner wall, and the insulated inner wall surrounds the outer wall of the magnetic body; and a bracket which is electrically and magnetically conductive and surrounds the insulated outer wall of the second magnetically insulated layer and connected to the conductive plate, and the bracket is magnetically insulated from the front wall and the outer wall of the magnetic body;

wherein the transmitter module has a first polarity at the front wall of the magnetic body thereof and a second polarity opposite to the first polarity at a front end of the bracket thereof, and the receiver module has the second polarity at the front wall of the magnetic body thereof and the first polarity at a front end of the bracket thereof, and the magnetic body and the bracket of the transmitter module have the same diameter as those of the receiver module, so that when the power and/or signal source is activated and the receiver module is connected to the transmitter module, the magnetic bodies and the brackets of transmitter module and the receiver module are rotatably attracted and connected to each other and power and/or signal is transmitted from the transmitter module to the receiver module via the conductive plates and the brackets thereof, and the conductive pins of the transmitter module and the receiver module connect with each other so that power and/or signal is transmitted from the transmitter module to the receiver module.

2. Magnetic means for detachably and rotatably connecting components in an audio speaker system as in claim 1, wherein a front end of the conductive pin of the receiver module is spring-loaded to movably protrude outward from the front wall of the magnetic body of the receiver module; and a front end of the conductive pin of the transmitter module is securely disposed within the first electrically insulated layer of the transmitter module.

3. Magnetic means for detachably and rotatably connecting components in an audio speaker system as in claim 1, wherein the front end of the bracket extends inward towards the magnet so as to provide more surface area for magnetically connecting the transmitter module and the receiver module and concentrate the magnetic force at the front end of the bracket.

4. Magnetic means for detachably and rotatably connecting components in an audio speaker system as in claim 3, wherein the second magnetically insulated layers each has a front wall which extends inward towards the magnetic bodies to insulate inner surface of the front end of the bracket from the front wall of the magnetic body and hold the magnetic bodies in place and thereby preventing the magnetic bodies from colliding with each other when the transmitter module and the receiver module connect with each other.

5. Magnetic means for detachably and rotatably connecting components in an audio speaker system as in claim 1, wherein an electrically insulated casing is provided at a rear end of the conductive plate for encasing the conductive pin.

6. Magnetic means for detachably and rotatably connecting components in an audio speaker system as in claim 1, wherein the magnetic body is in form of a magnetic material.

7. Magnetic means for detachably and rotatably connecting components in an audio speaker system as in claim 1, wherein the magnetic body is in form of a ferrite.

8. Magnetic means for detachably and rotatably connecting components in an audio speaker system as in claim 1, wherein the magnetic body is in form of a neodymium-ferrite-boron magnet.

9. Magnetic means for detachably and rotatably connecting components in an audio speaker system as in claim 1, wherein the bracket is made of a ferrous material.

10. Magnetic means for detachably and rotatably connecting components in an audio speaker system as in claim 1, wherein the bracket is made of iron.

* * * * *